US008286571B2

(12) United States Patent
Bertin

(10) Patent No.: US 8,286,571 B2
(45) Date of Patent: Oct. 16, 2012

(54) GUIDE APPARATUS FOR MOVING SUPPORTS FOR SENSORS AND THE LIKE OF SUBMARINES

(75) Inventor: Daniele Maria Bertin, Calderara Di Reno (IT)

(73) Assignee: Calzoni S.R.L. (IT)

( * ) Notice: Subject to any disclaimer, the term of this patent is extended or adjusted under 35 U.S.C. 154(b) by 427 days.

(21) Appl. No.: 12/312,045

(22) PCT Filed: Oct. 22, 2007

(86) PCT No.: PCT/IB2007/003145

§ 371 (c)(1),
(2), (4) Date: Apr. 23, 2009

(87) PCT Pub. No.: WO2008/050206

PCT Pub. Date: May 2, 2008

(65) Prior Publication Data

US 2010/0058969 A1 Mar. 11, 2010

(30) Foreign Application Priority Data

Oct. 23, 2006 (IT) ..... MI2006A2030

(51) Int. Cl.
*B63G 8/38* (2006.01)

(52) U.S. Cl. ..... 114/339

(58) Field of Classification Search ..... 114/339, 114/340; 440/54; 59/406; 384/45, 42; 212/350; 52/118

See application file for complete search history.

(56) References Cited

U.S. PATENT DOCUMENTS

| | | | | |
|---|---|---|---|---|
| 3,196,744 | A | 7/1965 | Werner | |
| 5,786,854 | A * | 7/1998 | Slade et al. | 348/373 |
| 7,111,745 | B2 * | 9/2006 | Nurse et al. | 212/350 |

FOREIGN PATENT DOCUMENTS

| | | |
|---|---|---|
| EP | 07 117 02 A | 5/1996 |
| EP | 1 177 974 A2 | 2/2002 |
| GB | 1 507 076 A | 4/1978 |

* cited by examiner

*Primary Examiner* — Edwin Swinehart
(74) *Attorney, Agent, or Firm* — Timothy J. Klima; Shuttleworth & Ingersoll, PLC

(57) ABSTRACT

A guide apparatus for supports (20) for sensors (30) able to move by translation in fixed guides (10) integral with the sail (Ia) of submarines (1) and the like upon activation of an actuator (40), where the fixed guide (10) has a polygonal cross-section, at each vertex (10*b*) of the guide (10) there being at least one structure with the shape of a prism (11) extending in the vertical direction (Z-Z) along the entire body of the guide, the prismatic elements (11) extending towards the inside of the guide (10) in such a way as to form at least two sliding surfaces (12) for corresponding sliding blocks (22) belonging to the tube (20) to be moved by translation.

11 Claims, 1 Drawing Sheet

GUIDE APPARATUS FOR MOVING SUPPORTS FOR SENSORS AND THE LIKE OF SUBMARINES

This application is the National Phase of International Application PCT/IB2007/003145 filed Oct. 22, 2007 which designated the U.S. and that International Application was published under PCT Article 21(2) in English.

TECHNICAL FIELD

The present invention relates to an apparatus for guiding and moving supports for sensors or the like of submarines.

BACKGROUND ART

In the submarine technical sector it is known that, when the submarine is at periscope depth, a predetermined number of passive and active sensors have to be carried out of the water, for example radar and/or radio antennae, optronic heads and the like, which are normally housed in the submarine tower (or sail) and integral with tubes able to move by translation which, when required, are translated vertically by suitable hydraulic and/or electric raising devices, until the sensors emerge from the surface of the water above the tower.

It is also known that the devices (sensors, periscopes, antennae, snorkels) are raised above the sail (submarine tower) using guides on which the supports of the devices to be raised slide.

Said guides usually consist of a longitudinal body, integral with a fixed structure, on which sliding surfaces are made, on which the sliding blocks integral with the sensor movable support slide.

The guides have various sliding surface layouts, guaranteeing linear movement with the required precision and support for the loads which tend to shift or bend the moving supports. The extent of these loads is usually very high when the submarine is moving due to the resistance offered by the water on the raised device.

One very efficient guide configuration is that described in EP 0 711 702 having a rectangular plan and sliding surfaces positioned at the vertices of the rectangle in such a way that the sliding blocks push towards the centre of the side which supports the sliding surface, so that the thrust from the sliding block is discharged on the entire wall, compressing it.

Although functional, said solution is very heavy in practice, whilst end users currently seek lighter guiding and raising devices.

For this purpose, the possibility of creating the guide structures using composite materials is also known. However, if the guide is made using composite material, structures of the known type have the problem deriving from the fact that the composite material of the flat wall has a reduced resistance when subjected to compression forces such as those seen in the prior art structures.

In addition, in the typical case of composite materials consisting of layers placed on top of one another, the composite material itself when compressed risks separation of the layers (delamination).

DISCLOSURE OF THE INVENTION

Therefore, the technical problem posed is that of providing a guide apparatus for tubes which support the sensors of submarines, which is particularly light and strong, compact, easy and inexpensive to make and assemble and easily installed on any submarine with fewer operations to be performed on site.

Accordingly, the present invention achieves these results with a guide apparatus for supports for sensors able to move by translation in fixed guides integral with the sail of submarines and the like upon activation of an actuator, wherein the fixed guide has a polygonal cross-section, and wherein at each vertex of the guide there is at least one structure having the shape of a prism extending in the vertical direction along the entire body of the guide, the prismatic elements extending towards the inside of the guide in such a way as to form at least two sliding surfaces for corresponding sliding blocks belonging to the tube to be moved by translation.

BRIEF DESCRIPTION OF THE DRAWINGS

Further details are provided in the following description of a non-limiting example of an embodiment of the present invention with reference to the accompanying drawings, in which.

DETAILED DESCRIPTION OF THE PREFERRED EMBODIMENTS OF THE INVENTION

Figure 1:
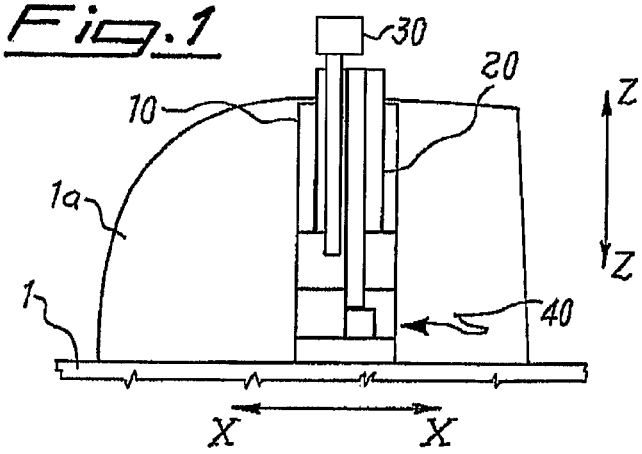
FIG. 1 is a schematic cross-section according to a vertical plane of the sail of a submarine with respective tube housed in the slide guide.

As illustrated in FIG. 1 for a convenient description only, without having a limiting effect, a reference set of three axes with a longitudinal direction X-X, a transversal direction Y-Y and a vertical direction Z-Z, a conventional apparatus for moving tubes 20 supporting sensors 30 (antennae, periscopes, etc.) and snorkels, contained in sails 1*a* integral with the body 1 of submarines, comprises a fixed guide 10 inside which the tube 20 supporting the sensors 30 translates longitudinally and is activated by an actuator 40.

Figure 2:
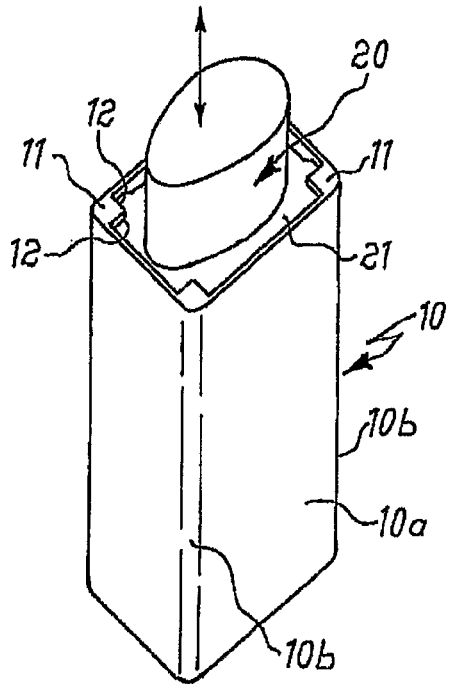
FIG. 2 is a schematic perspective view of the device in accordance with the present invention for guiding a submarine tube.
Figure 3:
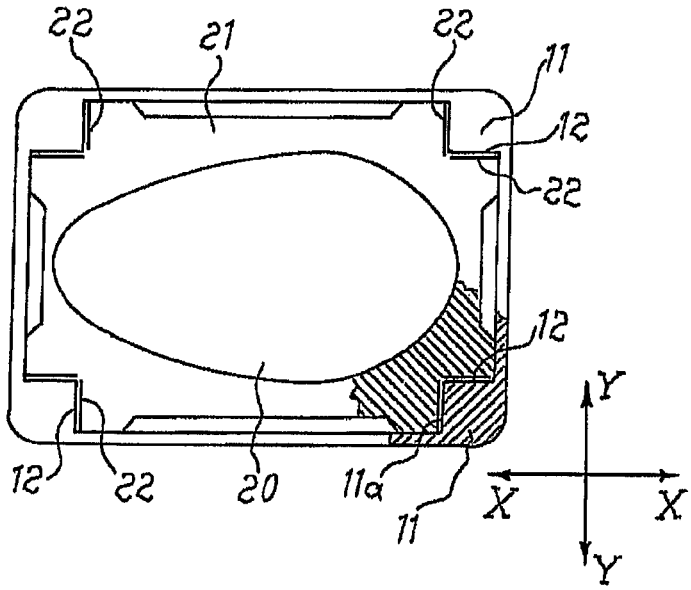
FIG. 3 is a plan view, partly in cross-section, of the device in accordance with the present invention.

According to the present invention (FIGS. 2 and 3), the fixed guide 10 has a polygonal cross-section, preferably rectangular with long sides 10*a* substantially parallel with the longitudinal direction X-X of submarine forward motion. At the vertices 10*b* of the polygon there are structures 11, running in the vertical direction Z-Z along the entire body of the guide 10, and extending towards the inside of the guide in such a way as to form at least two sliding surfaces 12 on which there slide respective sliding blocks 22 integral with elements 21 integral with the tube 20 and extending towards the outside of the tube.

According to the preferred embodiment illustrated in the accompanying drawings, the two longitudinal structures 11 have the shape of a polygonal prism and the two sliding surfaces 12 are at right angles to one another and respectively parallel with the two directions, longitudinal X-X and transversal Y-Y.

The prismatic structures 11 allow sustained discharge of local stresses due to the sliding block supports and give the entire structure a high level of bending strength.

In a first embodiment the sliding surfaces 12 consist of the material used to make the exposed surfaces of the prismatic element 11. However, in another embodiment the sliding surfaces may be made by means of a surface treatment on the material used to make the prismatic element, to give the exposed surfaces suitable wear and friction properties.

According to another embodiment, the sliding surfaces 11 are preferably made by placing a sheet 11*a* of material with suitable wear and friction properties (for example steel) on top of the material used to make the prismatic guide element 11.

According to an alternative embodiment, the prismatic elements 11 (FIG. 4) may be made of a composite material which, amongst other things, allows the sliding surfaces to be made directly by production of the part in the mould with the required precision and surface features.

However, the production of long bars of composite material with a closed cross-section and the required precision both of linearity along the length and surface finish is technically difficult and expensive. Therefore, the prismatic elements 111 are made of composite material by placing two sets of fibre layers on top of one another, respectively forming the perimeter surface 111*a* of the guide and the sides towards the inside of the sliding surfaces and between which a filler element 111*b* is inserted to create the prismatic element inner core.

The main function of the core is to create the prismatic element edge surfaces but, if made with structural material, it may increase the rigidity of the element.

If the core does not have a structural role, it may be made of a light material or with a material which can be removed in the production process.

Figure 4:
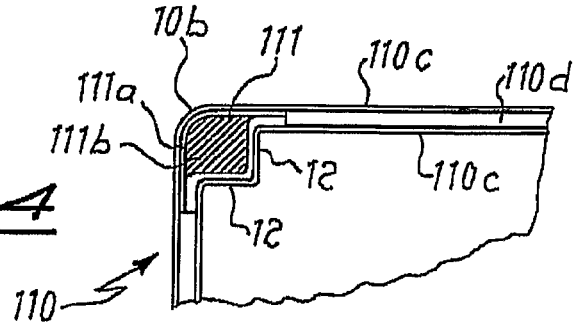
FIG. 4 is a plan view, partly in cross-section, of the detail of the guides of the device in accordance with the present invention.

As illustrated in FIG. 4, the lateral walls of the guide may be made of composite material with a sandwich structure having outer layers 110*c* which contain a spacer element 110*d*. In this way, the bending stresses on the lateral wall are offset.

As can be seen, the guide apparatus disclosed, and in particular the convex shape of the guide elements 11 and the matching concave shape of the sliding blocks 22 allows only a tensile stress to be applied on the guide structure, which always occurs at the vertices of the lateral walls of the guide structure and always towards the outside of it, thus preventing compression forces, and allowing it to be made of composite material, making the overall structure significantly lighter whilst having the same resistance to stresses as conventional guides.

The lower weight of the structure also results in reduced inertial loads from impacts, giving a structure resistant to minor stresses, having the advantage of also reducing the complexity and production cost.

The invention claimed is:

1. A guide apparatus for a movable support for a sensor of a submarine; comprising:

a fixed guide integral with a sail of the submarine, the fixed guide having a polygonal cross-section and a plurality of vertices;

a plurality of guide elements, each being positioned at one of the plurality of vertices of the fixed guide, each guide element including two sliding surfaces positioned adjacent each other and at an angle to each other and extending inward toward an interior of the fixed guide in a male configuration along substantially an entire length of the guide, the two sliding surfaces slideably engageable with sliding blocks of the support having a female configuration corresponding to the male configuration such that the support is slideably movable along the fixed guide.

2. The apparatus according to claim 1, wherein the fixed guide and the guide elements are made of composite material.

3. The apparatus according to claim 2, wherein at least one of the guide elements has a sandwich construction.

4. The apparatus according to claim 3, wherein the sandwich construction comprises:

two sets of fiber layers positioned on top of one another, respectively forming an exterior facing surface of the guide element and an interior facing surface of the guide element; and a filler element positioned between the two sets of fiber layers as an inner core of the guide element.

5. The apparatus according to claim 3, wherein walls of the fixed guide have a sandwich construction comprising a spacer element positioned between outer layers containing a spacer element.

6. The apparatus according to claim 2, wherein the guide elements are configured as closed bars having a right-angle quadrilateral shaped cross-section.

7. The apparatus according to claim 3, wherein the sandwich construction comprises fiber layers positioned on top of one another with a filler element positioned between the fiber layers to form an inner core.

8. The apparatus according to claim 1, wherein the guide elements include a surface treatment forming the sliding surfaces of the guide elements.

9. The apparatus according to claim 8, wherein the surface treatment includes a separate top layer of material applied over the guide elements.

10. The apparatus according to claim 9, wherein the separate top layer of material is steel sheet.

11. The apparatus according to claim 9, wherein the sliding surfaces are normal to one another.

* * * * *